US005424010A

United States Patent [19]

Duliba et al.

[11] Patent Number: 5,424,010

[45] Date of Patent: Jun. 13, 1995

[54] LIGHT DUTY LIQUID DETERGENT COMPOSITION CONTAINING 3-METHYL-3-METHOXY-BUTANOL

[76] Inventors: Edward P. Duliba, 30 Canterbury Ct., Piscataway, N.J. 08854; Sat J. Bedi, 1934 Oak Tree Rd., Edison, N.J. 08820

[21] Appl. No.: 2,503

[22] Filed: Jan. 6, 1993

[51] Int. Cl.[6] ..... C11D 3/43; C11D 1/12; C11D 11/00; C11D 17/00

[52] U.S. Cl. ..... 252/557; 252/153; 252/170; 252/171; 252/173; 252/174; 252/174.17; 252/558; 252/DIG. 14

[58] Field of Search ..... 252/170, 171, 162, 163, 252/164, 165, DIG. 14, 557

[56] References Cited

U.S. PATENT DOCUMENTS

| | | | |
|---|---|---|---|
| 2,316,234 | 4/1943 | Flett | 252/557 |
| 2,879,214 | 3/1959 | Divine | 204/157.78 |
| 3,640,882 | 2/1972 | Groves, Jr. | 252/121 |
| 3,856,695 | 12/1974 | Geiss et al. | 252/162 |
| 3,898,186 | 8/1975 | Mermelstein et al. | 252/528 |
| 3,901,832 | 8/1975 | Dugan et al. | 252/557 |
| 3,926,863 | 12/1975 | Perla | 252/121 |
| 3,954,660 | 5/1976 | Kennedy et al. | 252/353 |
| 4,175,062 | 11/1979 | Disch et al. | 252/540 |
| 4,483,779 | 11/1984 | Llenado et al. | 252/135 |
| 4,600,522 | 7/1986 | Grzeskowiak, Jr. | 252/170 |
| 4,732,696 | 3/1988 | Urfer | 252/174.17 |
| 4,732,707 | 3/1988 | Naik et al. | 252/548 |
| 4,747,977 | 5/1988 | Whitehead et al. | 252/111 |
| 4,753,750 | 6/1988 | Ouhadi et al. | 252/139 |
| 4,790,951 | 12/1988 | Frieser et al. | 252/162 |
| 4,943,392 | 7/1990 | Hastedt et al. | 252/539 |
| 5,008,031 | 4/1991 | Schulz et al. | 252/168 |
| 5,035,814 | 7/1991 | Maaser | 252/8.7 |
| 5,041,235 | 8/1991 | Kilbarger | 252/170 |
| 5,185,235 | 2/1993 | Sato et al. | 430/331 |

FOREIGN PATENT DOCUMENTS

| | | |
|---|---|---|
| 54-099106 | 8/1979 | Japan . |
| 63-168498 | 7/1988 | Japan . |
| 63-193998 | 8/1988 | Japan . |
| 2274800 | 11/1990 | Japan . |
| WO89/08697 | 9/1989 | WIPO . |

OTHER PUBLICATIONS

"3-Methyl-3-Methoxy Butanol"; Product Brochure by Kuraray Co., Ltd., Feb. 1992.

*Primary Examiner*—Paul Lieberman
*Assistant Examiner*—A. Hertzog

[57] ABSTRACT

The present invention relates to a light duty, liquid hand washing composition which is mild, stable foaming compositions especially effective in cleaning dishware, glasses, flatware, pots, pans, and delicate clothing by hand at ambient wash water temperature, as well as at warm or hot wash water temperatures. The composition comprises from about 20% to about 40% by weight of at least one anionic or nonionic surfactant; from about 0.5 to about 3.5% by weight of an alcohol which is 3-methyl-3-methoxy-butanol; from about 2% to about 8% of at least one hydrotrope; and from about 50% to about 70% water. The composition has a pH in the range of from about 6.0 to about 8.0 and a viscosity in the range of from about 100 cps to about 500 cps.

12 Claims, 2 Drawing Sheets

LIGHT DUTY LIQUID DETERGENT COMPOSITION CONTAINING 3-METHYL-3-METHOXY-BUTANOL

BACKGROUND OF THE INVENTION

The present invention pertains to light duty liquid detergents which are useful for hand washing dishes, pots, pans, glassware, and silverware. The composition additionally finds use as a hand washing composition for delicate clothing. In particular, the invention pertains to a liquid detergent composition including an improved viscosity modifying agent, namely 3-methyl-3-methoxy butanol.

Greasy soils are one of the most difficult types of soils to be removed by hand washing. Effective grease removal is nearly always associated with requiring high temperature water to help dissolve and remove the grease. It would be advantageous to formulate a mild, foaming, liquid hand dish washing composition, which is capable of and effective in removing greasy soils as well as other soil types from dishware using water at ambient or warm to high temperature. It has been known well known in the art to produce liquid detergents to use an aqueous solution of one or more anionic or nonionic surfactants in conjunction with a hydrotrope and a small amount of a viscosity control agent. Viscosity control agents are typically lower aliphatic alcohols such as ethanol and isopropanol. Without such a viscosity modifying agent, the detergent composition would be too thick to be useful. A problem with known viscosity modifying agents is that they have an objectionable odor and furthermore they have relatively high vapor pressures. For example, ethanol is a commonly used viscosity modifying agent, however it has a vapor pressure of approximately 46 mm Hg at 25° C. (CRC Handbook, Pg. D192, R. Weast, ed., CRC Press, Boca Raton, Fla., 1979). States are increasingly limiting the allowable vapor pressure of solvents which can be used in such compositions and it would be advantageous to have an effective viscosity modifying agent having a lower vapor pressure.

The use of solvents in liquid detergent compositions is widely known in the art. U.S. Pat. No. 4,753,750 teaches that the use of ethanol and $C_1$–$C_4$ etheric derivatives of lower polyols such as ethylene glycol as viscosity modifiers is known. The use of ethyl, propyl, butyl and amyl alcohol in cleaning compositions is known from U.S. Pat. Nos. 5,041,235; 5,035,814, 3,856,695 and 4,483,779. Liquid detergents including lower alcohols are shown in U.S. Pat. Nos. 5,008,031 and 4,790,951 and higher alcohols are shown in U.S. Pat. No. 4,732,696. U.S. Pat. No. 4,600,522 shows furfuryl and tetrahydrofurfuryl alcohols. U.S. Pat. No. 4,943,392 shows butoxy propanol and butoxy propoxypropanol and U.S. Pat. No. 4,747,977 shows $C_2$–$C_6$ aliphatic polyols. PCT/GB89/00227 shows $C_6$–C16 diols. Viscosity increasing additives such as dialkylethers are shown in U.S. Pat. No. 3,954,660.

It has now been found that 3-methyl-3-methoxybutanol is exceptionally useful as a viscosity modifier for light duty liquid hand washing compositions. It has the added benefits of having a low odor property and very low vapor pressure, on the order of 0.4 mm Hg. Accordingly, it is an object of this invention to provide light duty liquid hand washing aqueous detergent compositions which have commercially acceptable mildness, foaming, grease cleaning and foam rinseability properties, while using an improved viscosity modifier having low odor and a low vapor pressure.

The present invention provides compositions which accomplish the foregoing objectives and although prepared from otherwise known ingredients, when used in the instant context is capable of achieving a new and beneficial result.

SUMMARY OF INVENTION

Figure 1:
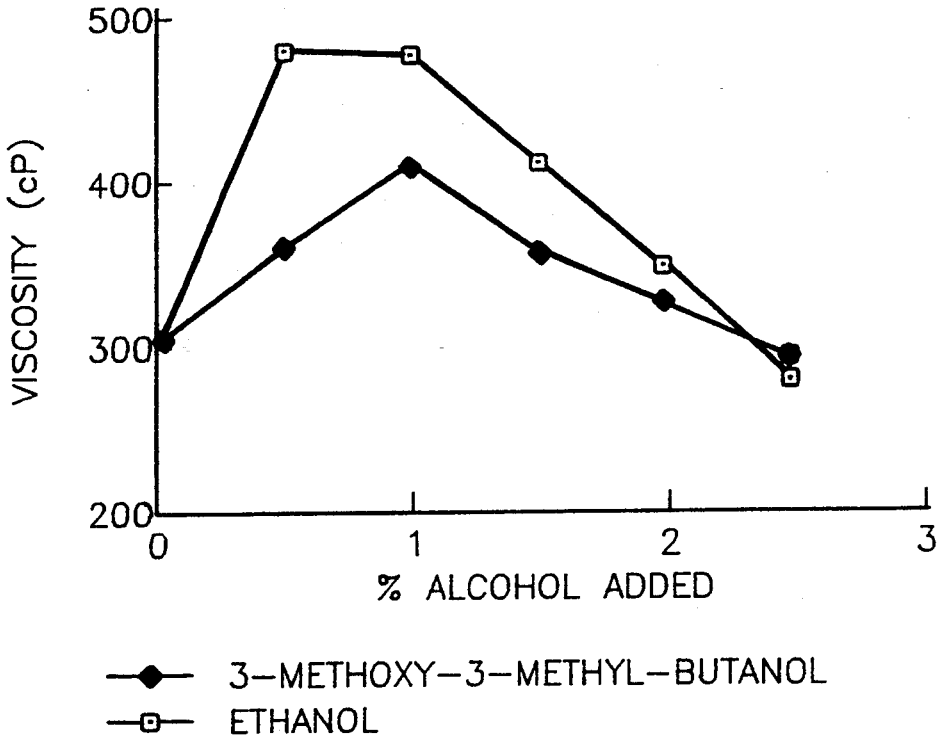
FIG. 1 shows a comparison of alcohol control of viscosity for the Example 2 detergent at 25° C. for denatured ethanol and 3-methyl-3-methoxy-butanol.

The present invention provides a light duty liquid hand washing composition which comprises:

(a) from about 20% to about 40% by weight of at least one anionic or nonionic surfactant;

(b) from about 0.5 to about 3.5% by weight of 3-methyl-3-methoxy-butanol;

(c) from about 2% to about 8% of at least one hydrotrope;

(d) balance water; wherein the composition has a pH adjusted in the range of from about 6.0 to about 8.0 and has a viscosity in the range of from about 100 cps to about 500 cps.

In the most preferred embodiment, alcohol (b) is 3-methyl-3-methoxy-butanol. Optional additional ingredients included in the instant composition are chelating or sequestering agents, coloring agents, dyes, perfumes, bactericides, foam stabilizers, fungicides, preservatives, sunscreening agents, pH modifiers, pH buffering agents, opacifiers, antioxidants, thickeners, proteins, and the like in minor amounts.

It is an object of the invention to reduce volatile organic compounds present in light duty liquid detergents by using an alcohol which has a low vapor pressure as the viscosity control agent and which functions in conjunction with the other compounds as a hydrotrope.

DETAILED DESCRIPTION AND PREFERRED EMBODIMENTS

As previously described, the invention pertains to a light duty liquid hand washing composition for dishes and clothing and comprises as essential components at least one anionic or onionic surfactant, an alcohol; which is preferably 3-methyl-3-methoxy-butanol, at least one hydrotrope, and water. The product in concentrated form, e.g. about a 38% by weight solution of the non-water parts, has a pH of from about 6.0 to about 8.0 and a viscosity of from about 100 cps to about 500 cps.

Virtually any anionic or nonionic surfactant can be used within the context of this invention. The anionic detergent component employed can be, for example, a sulfated or sulfonated synthetic organic detergent. The useful sulfated or sulfonated detergents include the linear higher alkylbenzene sulfonates, olefin sulfonates and paraffin sulfonates, as well as higher fatty alcohol sulfates, higher fatty alcohol polyethoxylate sulfates (of 3 to 30 ethoxy groups, preferably 3 to 15), monoglyceride sulfates, and other acceptable and commercially available sulfates or sulfonates of satisfactory detersive properties and stabilities in the present liquid detergent compositions. Such products will normally contain a lipophilic moiety which includes a higher aliphatic group, of which groups the most preferred is higher linear alkyl. Such alkyl will normally be of 8 to 20 carbon atoms, preferably being of 10 to 18 carbon atoms, e.g., lauryl, myristyl, and cetyl. While it is often preferred to utilize alkyls derived from natural fats and oils, synthetic products are also useful and often are interchangeable with those derived from natural sources. In some instances branched alkyls are useful but normally those which are linear or substantially linear will be preferred. It is a feature of this invention that although the mentioned detergent salts may be of ammonia or of certain alkanolamines to promote solubility in the aqueous medium, alkali metal salts, preferably sodium salts, are sufficiently soluble in such media in the present formulations so as to make clear products which are stable on storage and maintain their attractive clear appearances, as well as their functional activities. The most preferred anionic surfactants are di(alkali metal or ammonium) sulfosuccinates of $C_4$–$C_{22}$ fatty alcohols and more particularly to lauryl-myristyl disodium sulfosuccinates. These may be prepared described in U.S. Pat. Nos. 2,316,234; 3,926,863; 2,879,214; 3,901,832; 3,640,882 and French Patent 1,089,797 which are incorporated herein by reference.

The nonionic synthetic organic detergents employed in the practice of the invention may be any of a wide variety of such compounds, which are well known and are described at length in the text Surface Active Agents, Vol. II, by Schwartz, Perry and Berch, published in 1958 by Interscience Publishers, and in McCutcheon's Emulsifiers and Detergents, Vol.1 (International Ed. and North American Ed.) McCutcheon Division, MC Publishing Co., Glen Rock, N.J., 1992, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the polylower alkoxylated higher alkanol wherein the alkanol is of 9 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 10 to 11 or 12 to 15 carbon atoms and which contain from 3 to 9 lower alkoxy groups per mol. Preferably, the lower alkoxy is ethoxy but in some instances, it may be desirably mixed with propoxy, the latter, if present, usually being a minor (less than 50%) proportion. Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol® 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company. Other useful nonionics are represented by the Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Plurafac RA30 (a $C_{13}$–$C_{15}$ fatty alcohol condensed with 6 moles ethylene oxide and 3 moles propylene oxide), Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide), and Plurafac B26. Another group of liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide; Dobanol 25-7 is an ethoxylated $C_{12}$–$C_{15}$ fatty alcohol with an average of 7 moles ethylene oxide; etc. In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may contribute to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor, rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 20% but, as is in the cases of the mentioned Tergitols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of the viscosity and gel controlling compounds of the invention can also improve the properties of the detergents based on such nonionics. In some cases, as when a higher molecular weight polylower alkoxylated higher alkanol is employed, often for its detergency, the proportion thereof will be regulated or limited as in accordance with the results of various experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures. Mixtures of two or more of these liquid nonionics can also be used and in some cases advantages can be obtained by the use of such mixtures. Additional nonionic surfactants include mono- and polyglycosides having from about 9 to about 13 carbon atoms, on average, in the alkyl chain, and an average degree of polymerization in the range of from about 1 to 3.

In a preferred embodiment of a liquid dishwashing detergent composition, the anionic or nonionic surfactant is present in an amount of from about 20% to about 40%, or more preferably from about 25% to about 35% based on the weight of the overall composition.

An essential component of the invention is a viscosity modifying alcohol which is 3-methyl-3-methoxybutanol. The preferred embodiment of which is 3-methyl-3-methoxy butanol. This material is commercially available from Sattva Chemical Company of Stamford, Conn. and Kuraray Co., Ltd., Osaka, Japan. The 3-methyl-3-methoxy butanol component is present in an amount of from about 0.5% to about 3.5%, or more preferably from about 0.5% to about 2.5%, based on the weight of the overall composition.

The composition then contains at least one hydrotrope which stabilizes the compositions by aiding the solubilization of the components and preventing phase separation of the composition. The hydrotrope aids in maintaining a low clear point of the composition, and possibly modifying the viscosity of the composition. Hydrotropic agents include primary urea and the lower alkyl aryl sulfonate salts, alkali metal, ammonium, and triethanolammonium isopropylbenzene sulfonates, xylene sulfonates, toluene sulfonates, benzene sulfonates, (5 or 6)-carboxy-4-hexyl-2-cyclo-hexane-1-octanoic acid available from Westvaco Corporation, sodium benzoate, and mixtures thereof. Other hydrotropes include the $C_2$–$C_6$ alkyl glycosides described in U.S. Pat. No. 4,488,981 which is incorporated herein by reference. The most preferred hydrotropes are sodium xylene sulfonate, potassium xylene sulfonate, ammonium xylene sulfonate, sodium cumene sulfonate, and the like. In the preferred embodiment, the hydrotrope is present in the liquid detergent composition in an amount of from about 2% to about 8% and more preferably in an amount of from about 5% to about 7% based on the weight of the overall composition.

The liquid detergent compositions are formed by blending their components in water. The water is desirably deionized water but water of a hardness content up to about 300 p.p.m., as calcium carbonate may often be employed, although it is preferable for the water to be softened and for the hardness content to be less than 50 p.p.m., and preferably less than 20 p.p.m., to help to avoid destabilization of the composition. In the preferred embodiment of a water is present in an amount of from about 50% to about 70%, or more preferably from about 65% to about 70%, based on the weight of the overall composition.

The product viscosity and flow properties should be such as to make the composition pourable from a bottle and not so thin as to tend to splash or pour too readily, since usually only small quantities of the liquid detergent composition are to be employed in its intended use. The viscosity of the concentrated liquid detergent composition should usually be in the range of 100 to 500 centipoise and preferably 300 to 350 centipoise. The viscosity of the composition may be adjusted as desired by the 3-methyl-3-methoxy butanol. The composition liquid detergent will be readily pourable but will possess a desired "body".

The detergent composition may also contain adjuvants such as colorants, chelating or sequestering agents, perfumes, bactericides, salts, foam stabilizers, fungicides, preservatives, pH modifiers, pH buffering agents, opacifiers, antioxidants, thickeners, and the like in minor amounts. Such adjuvants components will usually be present in a very minor amount, often less than 5% and usually less than 1% by weight of the overall composition. Colorants may be present in an amount of from about 0.01% to about 0.3% by weight. Perfumes may be present in an amount of from about 0.1% to about 1.5% by weight. An important feature of the invention is that the pH of the concentrated detergent composition be as close to neutral as possible, i.e. from about 6.0 to about 8.0 and preferably 7.0 to 7.5 in order to avoid skin irritation.

Useful chelating agents or sequestrants employed in the instant composition include trisodium hydroxyethyl ethylene diamine tetraacetate (HEDTA), tetrasodium ethylene diamine tetraacetate (EDTA), trisodium nitrilotriacetate and trisodium hydroxyethyl ethylene diamine tetraacetate in amounts of from 0.01% to about 0.05%. These agents chelate heavy metal ions, counteract hard water and slow down bacteria growth. In another preferred embodiment, the composition includes an electrolyte to boost grease removal. Electrolytes such as magnesium chloride, magnesium sulfate and other sources of magnesium ions interact with anionic surfactants to give improved cleaning power. Any excess of the magnesium salt electrolyte will raise the cloudclear point of the composition. This undesirable effect can, however, be compensated for by the hydrotrope. Salts such as sodium chloride may be used as viscosity control agents for the detergent composition at concentrations of from about 0.5 to about 2 weight percent. The various adjuvant materials will be chosen for a compatibility with the other formula components and for non-separating and non-settling characteristics. Foam stabilizing and foam boosting may be provided by alkyl polyglucosides and alkanolamides. These improve on the grease removal performance of the composition. There may also be employed opacifying agents, e.g.

behenic acid, or a pearlescent or pearlizing composition, such as an approximately equal mixture of high fatty acid ester of polyethoxy ethanol, coconut oil fatty acid alkanolamide and sodium lauryl ether sulfate. The higher fatty acid will usually be of 10 to 18 carbon atoms and the polyethoxy content will be of 1 to 20, preferably 1 to 10 ethoxy groups. The alkanolamide will preferably be ethanolamide, but can be mixed with isopropanolamide. Bactericides include trichlorocarbanilide, tetrachlorosalicylanilide, hexachlorophene, chlorobromosalicylanilide. Colorants include dyes and water dispersable pigments. Salts include sodium sulfate and sodium chloride. Salts including sodium sulfate and sodium chloride, and bittering agents, such as magnesium sulfate. Preservatives include formaldehyde and hydrogen peroxide. The viscosities of the detergent compositions may be further varied by the addition of thickening agents, such as gums, cellulose derivatives, such as sodium carboxymethyl cellulose, polyacrylamide, Irish moss and the like.

In manufacturing the described formulations, it is usually preferred to heat the detergent constituents to a somewhat elevated temperature, e.g. 40° to 50° C. and then admix them with the water. First the anionic and nonionic detergents and water are added, with the more volatile materials, such as perfumes, preferably being added last and after cooling of the composition to about room temperature. Normally when making opaque or pearlescent detergents, the pearlizing mixture will also be added near last at about room temperature. Although the described method of making the compositions is preferred, various other known techniques may also be employed, depending upon the particular detergent composition.

The compositions of this invention in the specified proportions, as essential ingredients are formulated to provide mild, stable foaming liquid compositions especially effective in cleaning, by hand washing dishware, glasses, flatware, pots, pans, and delicate clothing, at ambient wash water temperature, as well as at warm or hot wash water temperatures. The invention formulations are mild to the hands and are homogeneous.

The pH of the concentrated formulation will generally be near neutral, e.g. about 6 to 8, preferably about 6.5 to 7.5.

The following non-limiting examples serve to illustrate the invention.

EXAMPLE 1

The following base composition is prepared (% by weight basis):

| | |
|---|---|
| magnesium bis(linear dodecyl benzene sulfonate) | 9.60 |
| Miranate LSS, lauric/myristic monoethanolamide, sodium xylene sulfonate mixture yielding: | |
| sulfosuccinate | 4.60 |
| lauric/myristic monoethanolamide | 2.00 |
| sodium xylene sulfonate | 1.23 |
| sodium cumene sulfonate | 2.10 |
| ammonium alcohol poly(oxyethylene)-1 sulfate | 11.80 |
| sodium chloride | 2.00 |
| lemon-lime color solution | 0.20 |
| Solarome odor | 0.38 |
| HEDTA solution (45% actives) | 0.20 |
| $MgSO_4.7H_2O$ | 1.00 |
| alkyl polyglycoside (Henkel APG 625) | 6.00 |
| deionized water | 58.89 |
| pH adjusted to 7.3 after preparation | |

The composition is a clear solution when prepared. This composition is separated and varying amounts of 3-methyl-3-methoxy-butanol (Kuraray) are added to the base composition as follows:

| Formulae | % by weight 3-methyl-3-methoxy-butanol |
|---|---|
| A | 0.50 |
| B | 1.00 |
| C | 1.50 |
| D | 2.00 |
| E | 2.50 |

Comparative performance:

| Formulae | viscosity (cP) | Ross-Miles foam height (cm) initial | Ross-Miles foam height (cm) 5 minute | dynamic interfacial tension (mN/m) |
|---|---|---|---|---|
| Control (No Solvent) | 914 | 15.4 | 14.6 | 1.99 |
| A | 705 | 15.2 | 14.3 | 2.03 |
| B | 622 | 15.0 | 14.2 | 2.01 |
| C | 513 | 14.9 | 14.0 | 2.06 |
| D | 428 | 15.5 | 14.5 | 2.03 |
| E | 292 | 16.2 | 14.6 | 2.06 |

The viscosity measured on the formulae is on a Brookfield RVTD digital viscometer operated at 10 RPM at room temperature with spindle #1. The dynamic interfacial tension is measured at a concentration of 1% wt of the product in deionized water at a flow rate of 0.0764 ml/min of olive oil at room temperature. The interfacial tension data are the average of two measurements made for ten minutes each. Ross-Miles foam heights are measured at a concentration of 0.1% wt of the product in deionized water according to ASTM procedure D1173-53, at room temperature.

EXAMPLE 2

The following composition base is prepared (% by weight basis):

| | |
|---|---|
| sodium linear dodecyl benzene sulfonate | 17.00 |
| $C_{12-15}$ alcohol poly(oxyethylene) | 13.00 |
| 3:1 ammonium sulfate | |
| solvent | varied |
| lauryl/myristyl monoethanolamide | 3.90 |
| sodium xylene sulfonate | 2.40 |
| sodium cumene sulfonate | 0.90 |
| magnesium sulfate | 0.50 |
| perfume | 0.32 |
| trisodium hydroxyethyl ethylene diamine tetraacetate | 0.083 |
| colorant | 0.003 |
| water | balance |

Figure 2:
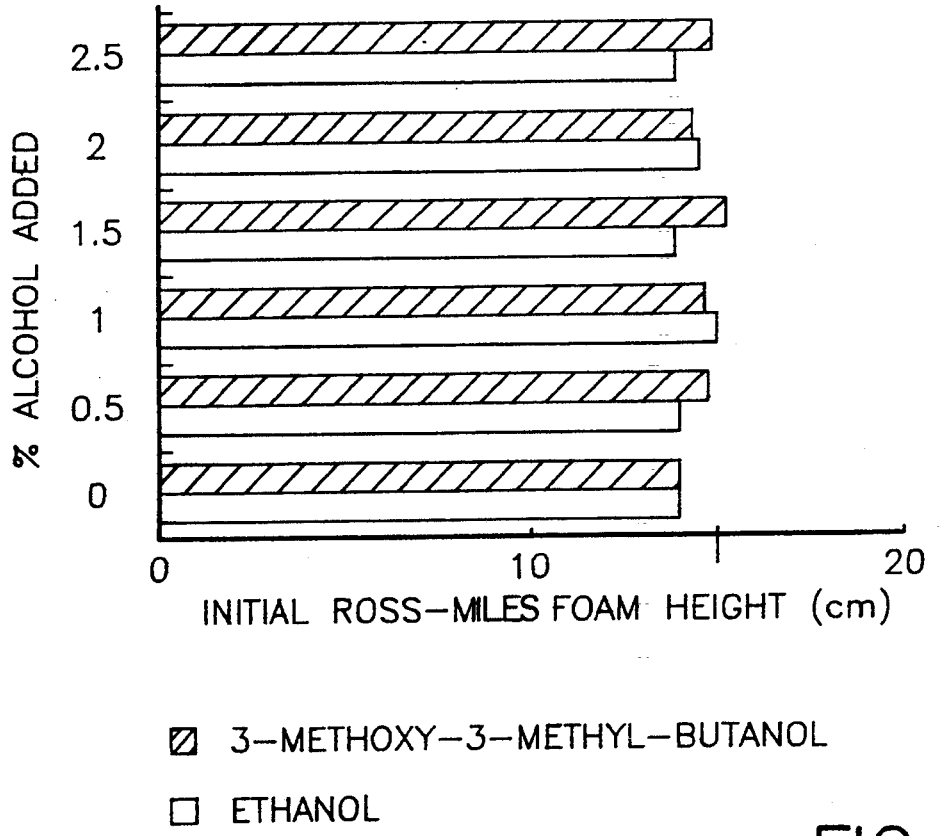
FIG. 2 shows a comparison of foam height for Example 2 compositions using denatured ethanol and 3-methyl-3-methoxy-butanol.
Figure 3:
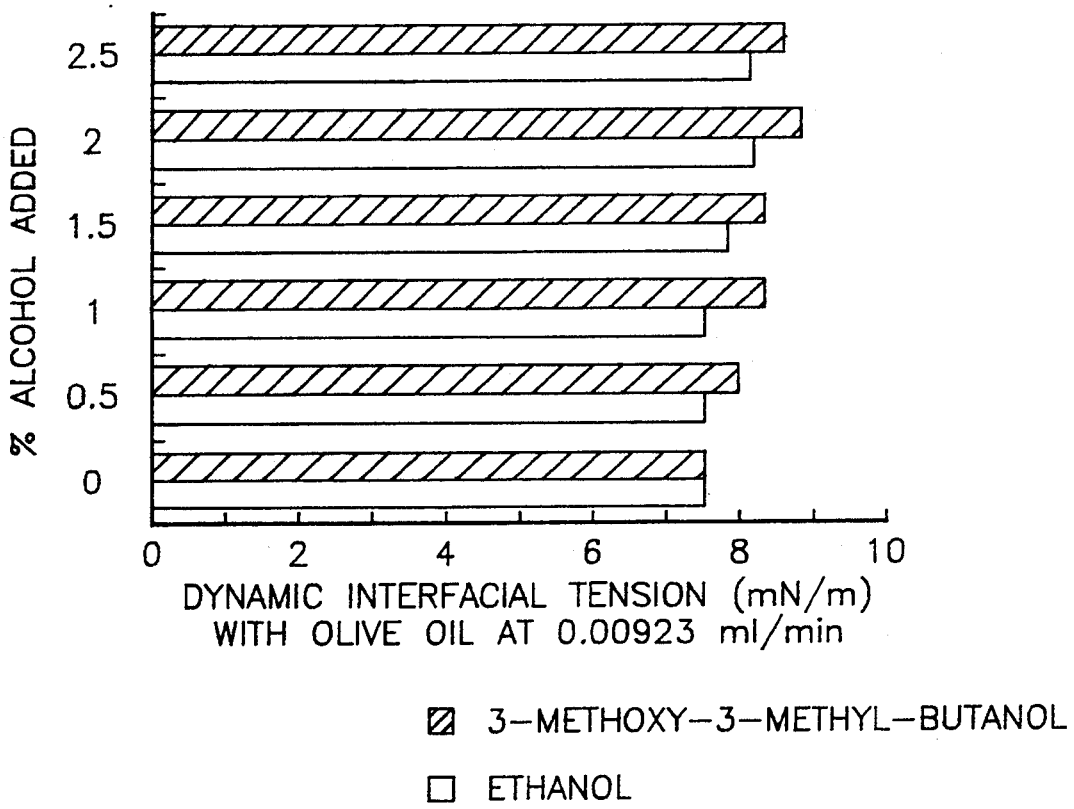
FIG. 3 shows a comparison of dynamic interfacial tension with olive oil for Example 2 detergent compositions using denatured ethanol and 3-methyl-3-methoxybutanol.

This composition is separated and varying amounts of denatured ethanol and 3-methyl-3-methoxy-butanol (Kuraray) are added to the base composition in the amounts of 0.00, 0.50, 1.00, 1.50, 2.00 and 2.50 percent by weight. FIG. 1 shows a comparison of alcohol control of viscosity for the above undiluted detergent at 25° C. for denatured ethanol and 3-methyl-3-methoxy-butanol. FIG. 2 shows a comparison of foam height for compositions using denatured ethanol and 3-methyl-3-methoxy-butanol (0.1% dilution of the detergent in deionized water at 25° C.). FIG. 3 shows a comparison of dynamic interfacial tension with olive oil for the above detergent composition using denatured ethanol and 3-methyl-3-methoxy-butanol (1% dilution of the detergent in deionized water at 25° C.). From these results one can see the lowered viscosity, improved foam height and dynamic interfacial tension with olive oil for the above detergent composition using 3-methyl-3-methoxy-butanol compared to denatured ethanol.

What is claimed is:

1. A light duty liquid detergent composition which consists essentially of:

(a) from about 20% to about 40% by weight of at least one anionic which is selected from the group consisting of di(alkali metal or ammonium) sulfosuccinates of C4–C22 fatty alcohols;

(b) from 0.5 to 2.5% by weight of 3-methyl-3-methoxy-butanol;

(c) from about 2% to about 8% of at least one hydrotrope; and (d) the balance being water; wherein the composition has a pH adjusted in the range of from about 6.0 to about 8.0 and has a viscosity in the range of from about 300 cps to about 500 cps.

2. The composition of claim 1, consisting essentially of (a) from about 25% to about 35% by weight of at least one anionic selected from the group consisting of di(alkali metal or ammonium) sulfosuccinates of C4–C22 fatty alcohols;

(b) from 0.5% to 2.5% by weight of 3-methyl-3-methoxy-butanol;

(c) from about 5% to about 7% of at least one hydrotrope; and, (d) the balance water; wherein the composition has a pH adjusted in the range of from about 7.0 to 7.5 and has a viscosity in the range of from about 300 cps to about 350 cps.

3. The composition of claim 1 wherein said anionic is lauryl-myristyl disodium sulfosuccinate.

4. The composition of claim 1 wherein the hydrotrope is selected from the group consisting of primary urea and the lower alkyl aryl sulfonate salts, (5 or 6)-carboxy-4-hexyl-2-cyclo-hexane-1-octanoic acid, sodium benzoate and $C_2$–$C_6$ alkyl glycosides.

5. The composition of claim 1 wherein the hydrotrope is selected from the group consisting of sodium xylene sulfonate, potassium xylene sulfonate, ammonium xylene sulfonate, sodium cumene sulfonate.

6. The composition of claim 1 consisting essentially of from about 5% to about 7% by weight of at least one hydrotrope.

7. The composition of claim 1 wherein water is present in an amount of from about 65% to about 70%, based on the weight of the overall composition.

8. The composition of claim 1 wherein the composition further consisting essentially of a minor amount of at least one component selected from the group consisting of colorants, chelating agents, perfumes, opacifying agents, pearlizing compositions, bactericides, salts, foam stabilizers, fungicides, preservatives, pH modifiers, antioxidants and bittering agents.

9. The composition of claim 1 wherein the composition further consisting essentially of a colorant in an amount of from about 0.01% to about 0.3% by weight.

10. The composition of claim 1 wherein the composition further consisting essentially of a perfume in an amount of from about 0.1% to about 1.5% by weight.

11. The composition of claim 1 wherein the composition further consisting essentially of a chelating agent in an amount of from about 0.01% to about 0.05% by weight.

12. A method of modifying the viscosity of a light duty liquid detergent composition, whose composition consists essentially of at least one anionic selected from the group consisting of di(alkali metal or ammonium) sulfosuccinates of C4–C22 fatty alcohols, at least one hydrotrope and water, the method comprising admixing the composition with 0.5 to 2.5% by weight of 3-methyl-3-methoxy-butanol.

* * * * *